United States Patent [19]

Kamp

[11] Patent Number: 4,555,068

[45] Date of Patent: Nov. 26, 1985

[54] METHOD FOR CALLING A BOBBIN-CHANGING DEVICE

[75] Inventor: Heinz Kamp, Wegberg, Fed. Rep. of Germany

[73] Assignee: W. Schlafhorst & Co., Moenchengladbach, Fed. Rep. of Germany

[21] Appl. No.: 587,941

[22] Filed: Mar. 9, 1984

[30] Foreign Application Priority Data

Mar. 10, 1983 [DE] Fed. Rep. of Germany ..... 3308454

[51] Int. Cl.[4] ..... B65H 63/00

[52] U.S. Cl. ..... 242/36; 242/37 R

[58] Field of Search ..... 242/36, 35.5 A, 37 R, 242/18 R; 200/61.15–61.18; 100/4

[56] References Cited

U.S. PATENT DOCUMENTS

| | | | |
|---|---|---|---|
| 3,490,709 | 1/1970 | Siegenthaler | 242/37 R |
| 3,665,844 | 5/1972 | Clark | 100/4 |
| 4,003,524 | 1/1977 | Taylor et al. | 242/18 R |
| 4,340,187 | 7/1982 | Schippers et al. | 242/35.5 A |

*Primary Examiner*—Leonard D. Christian

*Attorney, Agent, or Firm*—Herbert L. Lerner; Laurence A. Greenburg

[57] ABSTRACT

A method for calling a travelling bobbin-changing device to a winding station of a bobbin winding machine, each winding station having a thread presence monitor for monitoring the presence of a thread, a bobbin-stoppage indicator for indicating stoppage of rotation of the bobbin, and a bobbin filling indicator for indicating a predetermined fullness or thread length or diameter of the bobbin, includes continuously checking for the presence of a thread connected to the bobbin with the thread presence monitor, continuously checking for a stoppage of the rotation of the bobbin with the bobbin-stoppage indicator, continuously checking for the predetermined fullness or thread length or diameter of the bobbin with the bobbin filling indicator, issuing a signal when simultaneously the thread is present, the rotation of the bobbin has stopped and the predetermined fullness or thread length or diameter of the bobbin has been reached, and stopping the bobbin-changing device at the winding station for exchanging the bobbin with an empty bobbin tube when the signal is issued.

3 Claims, 1 Drawing Figure

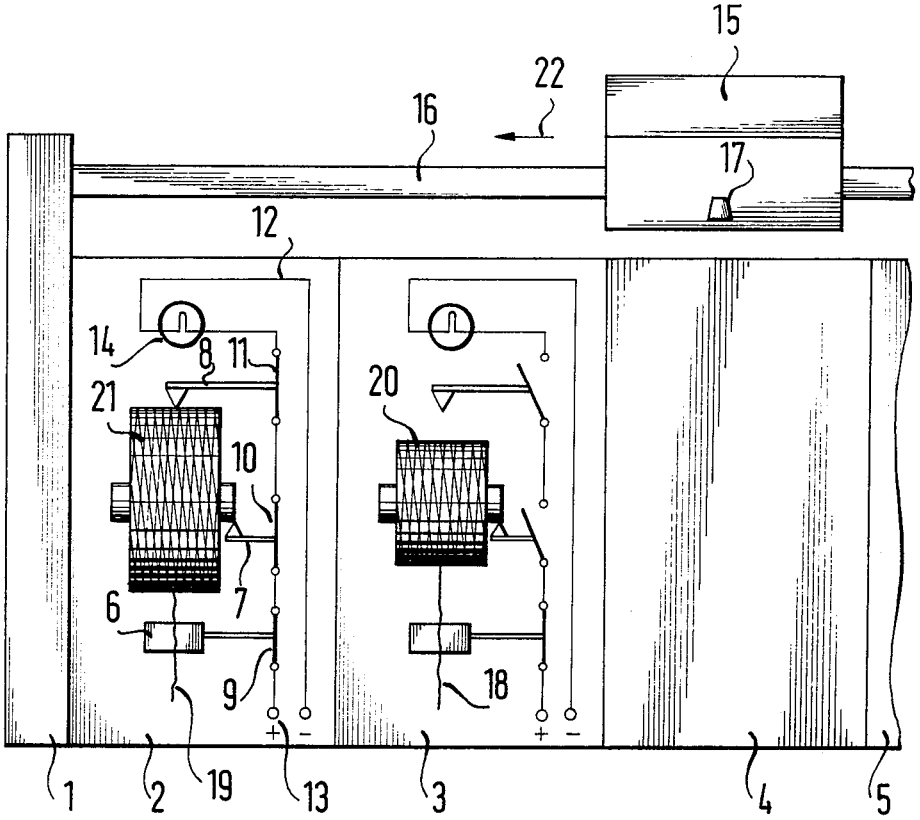
15
22
16
17
12
14
8
11
21
20
10
7
6
9
18
+
−
+
−
1
2
19
13
3
4
5

METHOD FOR CALLING A BOBBIN-CHANGING DEVICE

The invention relates to a method for calling a travelling bobbin-changing device to the winding stations of a bobbin winding machine, equipped with thread presence monitors, spool stoppage indicators and bobbin fullness or filling indicators.

The device for exchanging the bobbins can have its own track. It may shuttle back and forth passing the winding stations, so that it can become operative at the nearest winding station to it in the travel direction which gives it a calling signal. However, it may also stand still in a waiting position and wait for a calling signal from any winding station. Thus, a bobbin changing device of this type always takes care of several winding stations, or of a whole machine producing cross-wound bobbins.

During operation, cases do occur when the bobbin changing device could exchange the filled cross wound bobbin with an empty bobbin tube or sleeve, but this operation would be completely useless, because no thread is present which could be wound onto the new tube.

The total machine efficiency is considerably lowered in this way, especially if this occurs frequently during actual operation, because other winding stations where some thread is still present, have to wait. It would therefore be advantageous if the winding station idled because of the absence of thread, would not be serviced at all, and if the bobbin exchange would only be made at the winding stations which are not disturbed or out of order.

There are also cases during operation when the bobbin changing device is available quickly at the winding station, but it cannot be used yet, because the bobbin is still rotating, although it is filled. This is because it cannot be stopped quickly enough due to its considerable mass. In this case as well, it would be better to service another winding station first, rather than keep the bobbin changing device waiting. It would be even worse if the bobbin changing device would ignore the fact that the bobbin is still rotating, and would perform the spool exchange with the bobbin still rotating.

It is accordingly an object of the invention to provide a method for calling a bobbin-changing device, which overcomes the herein-afore-mentioned disadvantages of the heretofore-known methods of this general type, and to guarantee that the bobbin-changing device is only used at the winding stations where all conditions for a problem-free and rapid spool exchange are fulfilled without unnecessary waiting times.

With the foregoing and other objects in view there is provided, in accordance with the invention, a method for calling a travelling cheese or cross-wound bobbin-changing device to a winding station of a bobbin winding machine, each winding station having a thread presence monitor for monitoring the presence of thread, a bobbin stoppage indicator for indicating stoppage of rotation of the bobbin, and a bobbin filling indicator for indicating a predetermined fullness or thread length or diameter of the bobbin, which comprises continuously checking or testing for the presence of a thread connected to the bobbin with the thread presence monitor, continuously checking or questioning for a stoppage of the rotation of the bobbin with the bobbin stoppage indicator, continuously checking or interrogating for the predetermined fullness or thread length or diameter of the bobbin or spool with the bobbin filling indicator, issuing or automatically generating a signal when simultaneously the thread is present, the rotation of the bobbin has stopped and the predetermined fullness or thread length or diameter of the bobbin has been reached, and stopping the bobbin-changing device at the winding station for exchanging the bobbin with an empty bobbin tube when the signal is issued.

A winding station at which all of the conditions for a problem-free, rapid and undisturbed bobbin exchange are not present, cannot call the bobbin-changing device, which would keep it waiting in certain cases. The degree of efficiency and profitability is increased if this fact is considered with respect to the whole bobbin producing machine. The loss of the use of the bobbin-changing device due to waiting times is also completely avoided.

Other features which are considered as characteristic for the invention are set forth in the appended claims.

Although the invention is illustrated and described herein as embodied in a method for calling a bobbin-changing device, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying single figure of the drawing, which is a fragmentary, diagrammatic, front-elevational view of a device for carrying out the method, including schematic circuitry.

Referring now to the figure of the drawing in detail, there is seen a machine 1 producing cheeses or cross-wound bobbins, which has a number of winding stations 2 to 5 that are illustrated diagrammatically in the drawing. Each winding station is provided with a thread presence monitor 6, a cheese or cross-wound bobbin-stoppage indicator 7, and a bobbin filling indicator 8, which indicates that a predetermined fullness, diameter or thread length of the bobbin has been reached, as shown at the winding station 2, for example. The thread presence monitor 6 which senses the presence of the thread is provided with a switching element 9, the bobbin-stoppage indicator 7 has a switching element 10, and the bobbin filling indicator 8 has a switching element 11. An electric connection 12 leads from the plus or positive pole of a voltage source 13 through the switching elements 9, 10, 11 and through a light or visual indicator 14 back to the minus or negative pole of the voltage source.

A bobbin-changing device 15 travels back and forth on a track 16 alongside the machine 1, and detects the visual indicators 14 with a photo sensor 17, when passing by.

At the winding station 3, the thread 18, is present and the switching element of the thread presence monitor is accordingly closed. The cross-wound bobbin 20 is rotating and the switching element of the bobbin-stoppage monitor is therefore open. The bobbin 20 is not yet full, so that the switching element of the spool filling indicator is also open. No current flows through the visual indicator and it is dark for this reason.

At the winding station 2, the thread 19 is present and the switching element 9 of the thread presence monitor 6 is therefore closed. The bobbin is standing still and accordingly the switching element 10 of the bobbin-stoppage indicator 7 is also closed. The bobbin has reached the predetermined filling amount, and therefore the switching element 11 of the bobbin filling indicator 8 is also closed. Thus, a closed circuit connection through the visual indicator is formed, and the visual indicator is lighted.

The bobbin stopage indicator 7 may be in the form of a number of devices which are well known in the art. The device may be a hydraulic system as disclosed in U.S. Pat. No. 3,665,844 or it may use a toothed wheel attached to the bobbin tube, the motion of which is sensed by a magnet coil which is fed to an amplifier and then to the switching element 10, as shown in German Published, Prosecuted application No. DE-AS 19 13 451.

The bobbin-changing device 15 is assumed to be travelling in the direction of the arrow 22. Since the visual indicator of winding station 3 is dark, the device passes this winding station without stopping. However, when the device 15 comes in front of the winding station 2, the photo sensor 17 detects the visual indicator 14, the bobbin-changing device 15 stops at this winding station, and the filled bobbin 21 is exchanged with an empty bobbin tube. After performing its task, the bobbin exchanging device 15 moves again and travels in the opposite direction.

The invention is not limited to the illustrated and described embodiment which is used as an example.

The foregoing is a description corresponding in substance to German application No. P 33 08 454.8, filed Mar. 10, 1983, the International priority of which is being claimed for the instant application and which is hereby made part of this application. Any material discrepancies between the foregoing specification and the aforementioned corresponding German application are to be resolved in favor of the latter.

I claim:

1. Method for calling a travelling bobbin-changing device to a winding station of a bobbin winding machine, each winding station having a thread presence monitor for monitoring the presence of a thread, a bobbin-stoppage indicator for indicating stoppage of rotation of the bobbin, and a bobbin filling indicator for indicating a predetermined fullness of the bobbin, which comprises continuously checking for the presence of a thread connected to the bobbin with the thread presence monitor, continuously checking for a stoppage of the rotation of the bobbin with the bobbin-stoppage indicator, continuously checking for the predetermined fullness of the bobbin with the bobbin filling indicator, issuing a signal when simultaneously the thread is present, the rotation of the bobbin has stopped and the predetermined fullness of the bobbin has been reached, and stopping the bobbin-changing device at the winding station for exchanging the bobbin with an empty bobbin tube when the signal is issued.

2. Method for calling a travelling bobbin-changing device to a winding station of a bobbin winding machine, each winding station having a thread presence monitor for monitoring the presence of a thread, a bobbin-stoppage indicator for indicating stoppage of rotation of the bobbin, and a bobbin filling indicator for indicating a predetermined thread length of the bobbin, which comprises continuously checking for the presence of a thread connected to the bobbin with the thread presence monitor, continuously checking for a stoppage of the rotation of the bobbin with the bobbin-stoppage indicator, continuously checking for the predetermined thread length of the bobbin with the bobbin filling indicator, issuing a signal when simultaneously the thread is present, the rotation of the bobbin has stopped and the predetermined thread length of the bobbin has been reached, and stopping the bobbin-changing device at the winding station for exchanging the bobbin with an empty bobbin tube when the signal is issued.

3. Method for calling a travelling bobbin-changing device to a winding station of a bobbin winding machine, each winding station having a thread presence monitor for monitoring the presence of a thread, a bobbin-stoppage indicator for indicating stoppage of rotation of the bobbin, and a bobbin filling indicator for indicating a predetermined diameter of the bobbin, which comprises continuously checking for the presence of a thread connected to the bobbin with the thread presence monitor, continuously checking for a stoppage of the rotation of the bobbin with the bobbin-stoppage indicator, continuously checking for the predetermined diameter of the bobbin with the bobbin filling indicator, issuing a signal when simultaneously the thread is present, the rotation of the bobbin has stopped and the predetermined diameter of the bobbin has been reached, and stopping the bobbin-changing device at the winding station for exchanging the bobbin with an empty bobbin tube when the signal is issued.

* * * * *